US008387388B2

(12) United States Patent
Glos et al.

(10) Patent No.: US 8,387,388 B2
(45) Date of Patent: Mar. 5, 2013

(54) TURBINE BLADE

(75) Inventors: Stefan Glos, Recklinghausen (DE); Matthias Heue, Bochum (DE); Ernst-Wilhelm Pfitzinger, Mülheim an der Ruhr (DE); Norbert Pieper, Duisburg (DE)

(73) Assignee: Siemens Aktiengesellschaft, München (DE)

( * ) Notice: Subject to any disclaimer, the term of this patent is extended or adjusted under 35 U.S.C. 154(b) by 913 days.

(21) Appl. No.: 12/521,589

(22) PCT Filed: Dec. 19, 2007

(86) PCT No.: PCT/EP2007/064237

§ 371 (c)(1), (2), (4) Date: Jun. 29, 2009

(87) PCT Pub. No.: WO2008/080854

PCT Pub. Date: Jul. 10, 2008

(65) Prior Publication Data

US 2010/0313564 A1 Dec. 16, 2010

(30) Foreign Application Priority Data

Jan. 4, 2007 (EP) ..... 07000140

(51) Int. Cl.
*F01K 13/02* (2006.01)
*F01K 7/34* (2006.01)

(52) U.S. Cl. ..... 60/653; 60/654; 60/646; 60/657; 60/679

(58) Field of Classification Search ..... 60/646, 60/657, 653, 654, 677–679
See application file for complete search history.

(56) References Cited

U.S. PATENT DOCUMENTS

| | | | | |
|---|---|---|---|---|
| 2,811,837 | A * | 11/1957 | Eggenberger | 60/656 |
| 3,216,199 | A * | 11/1965 | Shaw et al. | 60/670 |
| 3,875,384 | A * | 4/1975 | Davis | 700/82 |
| 3,943,718 | A * | 3/1976 | Berry | 60/676 |
| 4,368,520 | A * | 1/1983 | Hwang et al. | 700/289 |
| 6,951,105 | B1 * | 10/2005 | Smith | 60/646 |

FOREIGN PATENT DOCUMENTS

| | | | |
|---|---|---|---|
| DE | 4432960 | C1 | 11/1995 |
| DE | 10227709 | A1 | 2/2003 |
| WO | 2006103270 | A1 | 10/2006 |

OTHER PUBLICATIONS

Communication from Yamaguchi International Patent Office, Jul. 28, 2011, pp. 1-2, 1-3.

* cited by examiner

*Primary Examiner* — Hoang Nguyen

(57) ABSTRACT

The invention relates to a method for increasing the steam mass flow of a high-pressure steam turbine of a steam power plant, particularly a steam power plant including reheating, during a start-up phase of the steam power plant, particularly also during an idle period of the steam power plant, wherein at least one electric consumer is connected upstream of a generator of the steam power plant before synchronization with a power supply grid. The invention further relates to a steam power plant, comprising a generator, a high-pressure steam turbine, and at least one electric consumer, which can also be connected during a start-up phase of the steam power plant, particularly also during an idle period of the steam power plant, in order to increase a steam mass flow of the high-pressure steam turbine before a synchronization process of the generator with a power supply grid.

5 Claims, 1 Drawing Sheet

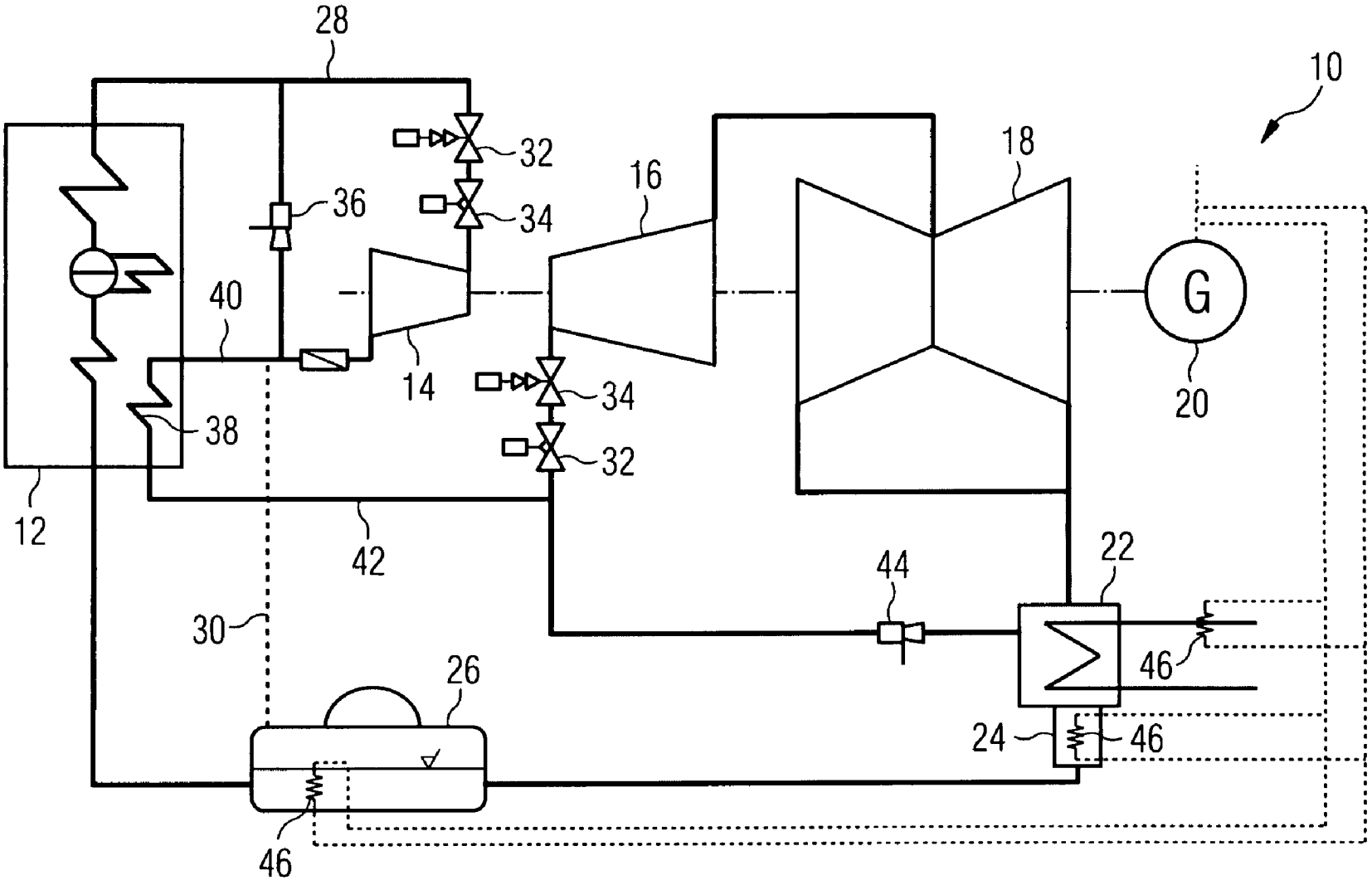
10
G
20
18
22
46
46
24
44
16
34
32
32
34
14
26
28
36
42
46
40
38
30
12

TURBINE BLADE

CROSS REFERENCE TO RELATED APPLICATIONS

This application is the US National Stage of International Application No. PCT/EP2007/064237, filed Dec. 19, 2007 and claims the benefit thereof. The International Application claims the benefits of European application No. 07000140.9 filed Jan. 4, 2007, both of the applications are incorporated by reference herein in their entirety.

FIELD OF THE INVENTION

The invention relates to a method for increasing the steam mass flow in a high-pressure steam turbine of a steam power station, in particular a steam power station with intermediate superheating, during a starting-up phase of the steam power station, in particular also while the steam power station is running on no load.

BACKGROUND OF THE INVENTION

When a fossil-fueled power station is being started or started up, the boiler of the power station is first of all raised to a minimum load (generally 30 to 40%). The fresh steam which is produced during this starting-up phase in this case normally initially bypasses the steam turbine in the (so-called) bypass mode. In the case of installations having intermediate superheating, the fresh steam is in this case passed via a high-pressure bypass station, is reduced to a lower temperature level, and is then passed to the cold branch of the intermediate superheating. The steam leaving the hot branch of the intermediate superheating is passed via a medium-pressure bypass station and, after being cooled by means of injected water, is passed to the condenser. A high pressure level in the intermediate superheating (normally about 20-30 bar) in this case ensures effective cooling of the intermediate superheating tubes, to which flue gas is applied.

When a high-pressure turbine in the steam power station is accelerated to the rated rotation speed from this bypass mode as described above, then the high pressure in the cold branch of the intermediate superheating leads, at the outlet of the high-pressure turbine, to temperatures which are considerably higher than during rated load operation, particularly in the case of hot starting or warm starting. The reason for this is the small temperature decrease and small amount of surging in the high-pressure turbine when the mass flows are low. This no-load mass flow cannot be increased, because of the rotation-speed regulation, since the turbine-generator run cannot yet emit any power to the network. During this phase, the turbine produces only the power loss in the bearings and generator which, depending on the installation size, is normally in the range from 2 to 5 MW. This power cannot be increased until after synchronization to the network.

The high temperatures which therefore occur before synchronization make it necessary to design the waste-steam area of the high-pressure turbine and the line of the cold branch of the intermediate superheating such that they withstand the increased temperatures, in particular also the temperatures, which change to a major extent during start-up and shut-down. At the moment, this is possible by the use of relatively cost-effective materials in the design of the turbine and the line of the cold branch of the intermediate superheating. However, during hot starting in future installations, in order to increase the fresh-steam temperatures of about 565° C. that are normally used nowadays with an associated high-pressure waste-steam temperature of at most approximately 500° C. to a maximum of about 700° C. with associated waste-steam temperatures of about 580° C. to 600° C. at times, it is necessary to also use considerably more expensive materials, in particular 10%-Cr-steel, in the high-pressure waste-steam area and in the cold branch of the intermediate superheating.

Other known solutions are following the aim of suitable cooling. For example, in the past, so-called start-up lines had been used, which connect the high-pressure waste-steam area directly to the condenser, for start-up. In this case, the expansion line is lengthened and surging in the high-pressure turbine is prevented by reducing the high-pressure waste-steam pressure during start-up and no-load running. However, an additional, relatively large line and water injection are required for this purpose. It is also known for other start-up concepts to be pursued. For example, it is known for flue gas to bypass intermediate superheated tubes via boiler valves. These tubes therefore need not be cooled, and the steam turbine can be started up with very low pressures in the cold branch of the intermediate superheating. In another known start-up concept, the high-pressure turbine first of all runs in an evacuated form, and is connected to the network only after synchronization.

Considered overall, the cooling solutions and start-up concepts described above as well as the inclusion of heat-resistant materials are highly complex and costly, thus resulting in a need for better solutions in order to reduce the high temperatures which occur before network synchronization.

SUMMARY OF THE INVENTION

The invention is based on the object of specifying a method by means of which the high temperatures which occur during a starting-up phase of a steam power station before network synchronization can be reduced without major complexity and as cost-effectively as possible.

According to the invention, this object is achieved by the method mentioned initially for increasing the steam mass flow in a high-pressure steam turbine of a steam power station, which in particular has intermediate superheating, during a starting-up phase, and in particular when the steam power station is running on no load, in which method at least one electrical load is connected to a generator in the steam power station before synchronization to an electrical power supply network.

The method according to the invention artificially increases the no-load power on the electrical side, associated with a corresponding increase in the steam mass flow even before synchronization to an electrical power supply network. Thus, according to the invention, the high-pressure turbine, in particular, of a steam power station can produce more power with an increased steam mass flow such that the generator is actually excited at an early stage, and electrical loads are connected to the generator even before network synchronization. This power which is produced electrically is emitted to electrical loads, preferably in the form of resistors, which must be correspondingly cooled. The increased steam mass flow involved with the method according to the invention, even before network synchronization means that the high-pressure turbine, in particular, surges less on no load, and the waste-steam area and the line of the cold branch of the intermediate superheating can therefore be designed using more cost-effective materials, even for very high fresh-steam temperatures, in particular because the temperatures differences between no load and rated load operation are no longer so severely pronounced.

In one advantageous development of the method according to the invention, the electrical load, preferably in the form of an electrical resistor, is arranged in a feed-water container of the steam power station, in order to cool the electrical load. This is advantageous because, in this case, the condensate, which flows in at a relatively cold temperature, must be heated to the saturation vapor temperature at the pressure, which is required for degassing, of normally 5 to 10 bar. There is therefore no need to extract an excessively large steam mass flow from the cold branch of the intermediate superheating, and a greater mass flow is available to cool the intermediate superheater tubes. The energy involved with this can be used, as a result of which, in the end, a fuel saving can be achieved.

In a further advantageous development of the method according to the invention, the electrical load is arranged in a condensation collection container of a condenser of the steam power station. The arrangement of the electrical load in the condensation collection container of the condenser (hot well) has no influence on the thermal performance of the condenser, since the mass flow decreases in a corresponding manner via a corresponding medium-pressure bypass station. Alternatively, the electrical load can also be cooled by arranging the electrical load in the cooling water of the steam power station, in which case both main cooling water and secondary cooling water can be used for cooling.

The invention also relates to a steam power station by means of which the method according to the invention can be carried out, having a generator, a high-pressure steam turbine and at least one electrical load, which can be connected to the generator during a starting-up phase of the steam power station, in order to increase a steam mass flow in the high-pressure steam turbine before synchronization of the generator to an electrical power supply network. The electrical load is preferably arranged in a feed-water container of the steam power station, in a condensation collection container of a condenser of the steam power station, or in the cooling water of the steam power station.

BRIEF DESCRIPTION OF THE DRAWINGS

One exemplary embodiment of a steam power station according to the invention will be explained in more detail in the following text with reference to the attached drawing, in which shows the design of a steam power station according to the invention.

DETAILED DESCRIPTION OF THE INVENTION

The drawing shows, schematically, the design of a steam power station 10 according to the invention. The steam power station 10 comprises, inter alia, a boiler 12, a high-pressure turbine 14, a medium-pressure turbine 16, a low-pressure turbine 18, a generator 20, a condenser 22 with a collection container 24, a feed-water container 26 with a degasser, fresh-steam lines 28 and a supporting line 30.

When the steam power station 10 is being started or started up, the boiler 12 is first of all operated on a minimum load (generally 30-40%), with the steam that is produced normally initially bypassing the high-pressure turbine 14 (bypass mode). The bypass mode is in this case provided by closing the quick-closure valve 32 or control valve 34 which is arranged in the steam inlet-flow area of the high-pressure turbine 14, with the fresh steam being passed via a high-pressure bypass station 36, being reduced to a lower temperature level, and then being supplied to intermediate superheating 38, to be precise first of all the cold branch 40 of the intermediate superheating. The steam which leaves the hot branch 42 of the intermediate superheating is passed via a medium-pressure bypass station 44 and, after being cooled by means of water injection, is passed to the condenser 22. In this case, effective cooling of the intermediate superheater tubes, to which flue gas is applied, is ensured by a high pressure level in the intermediate superheating 38 (normally about 20-30 bar).

If the high-pressure turbine 14 is now accelerated to the rated rotation speed, from this bypass mode, after opening the quick-closure valve 32 or control valve 34, then the high pressure in the cold branch 40 of the intermediate superheating leads, at the outlet of the high-pressure turbine 14, to temperatures which are considerably higher, particularly during hot starting or warm starting, than when on rated load. The reason for this is the small temperature decrease, and little surging, in the high-pressure turbine 14 when the steam mass flows are low. This no-load mass flow cannot be increased because of the rotation-speed control, since the turbine-generator run cannot yet emit any power to the network. The power and therefore the mass flow can be increased only after synchronization to the network, although the temperature differences between the steam and the components of the turbines must not become excessive. For the waste-steam area of the high-pressure turbine 14 and the cold branch 40 of the intermediate superheating, this means that they are subjected to greatly increased and highly fluctuating temperatures which, in some circumstances, require the use of expensive materials to design the waste-steam area of the high-pressure turbine 14 and the cold branch 40 of the intermediate superheating.

In order, in particular, to make it possible to dispense with the use of expensive heat-resistant materials, according to the invention, at least one electrical load in the form of an electrical resistor 46 can be connected to the generator 20 (cf. dotted lines in the drawing). The resistor 46 or the resistors 46 can, according to the invention, be arranged in the feed-water container 26, in the condensation collection container 24 or in the cooling water, in order to cool it or them. If the generator 20 is excited in an early stage, according to the invention, before synchronization of the generator 20 to an electrical power supply network, then one or more of the electrical resistors 46 can be connected. The no-load power on the electrical side can therefore be artificially raised even before synchronization, resulting in a corresponding increase in the steam mass flow. This has the advantage that, particularly in the high-pressure turbine 14, the expansion line on no load is lengthened and the steam surge is less, and the waste-steam area and the line of the cold branch 40 of the intermediate superheating can therefore be designed using cost-effective materials, even for very high fresh-steam temperatures, in particular because the temperature differences between no load and rated load operation are no longer so severely pronounced.

When electrical resistors 46 are arranged in the feed-water container 26, the tubes of the intermediate superheating 38 are in this way cooled to a greater extent since less steam must be taken from the cold branch 40 of the intermediate superheating via the supporting line 30 to the feed-water container 26 in order to ensure degassing.

The mass flow, which is now higher on no load, through the high-pressure turbine 14 leads to a greater decrease in the enthalpy, and thus to lower high-pressure waste-steam temperatures. For example, an increase in the no-load power from 5 to 15 MW (assumption: fresh-steam temperature 700° C., pressure in the cold branch 40 of the intermediate superheating 20 bar) would result in reduction in the high-pressure waste-steam temperature from 580° C. to 510° C.

The invention claimed is:

1. A method for increasing a steam mass flow in a high-pressure steam turbine of a steam power station during a starting-up phase of the steam power station, comprising:

providing the steam power station comprising a boiler, a high-pressure turbine, a medium-pressure turbine, a low-pressure turbine, and a generator;

connecting a bypass line around the high-pressure turbine;

arranging a high-pressure bypass station in the bypass line whereby when the power station is in the starting up phase and the boiler is operating in a minimum load, the steam produced bypasses the high-pressure turbine in the bypass line via a high-pressure bypass station and supplied to an intermediate superheating within the boiler;

connecting a supporting line from a feed-water container to the intermediate superheating;

connecting an electrical load to a generator of the steam power station; and synchronizing the generator to an electrical power supply network after the connection of the electrical load, wherein the electrical load is arranged in the feed-water container of the steam power station.

2. The method as claimed in claim 1, wherein the electrical load is an electrical resistor.

3. A steam power station, comprising:

a generator;

a high-pressure steam turbine;

a medium-pressure steam turbine;

a low-pressure steam turbine;

a boiler;

a bypass line which connects the boiler to an intermediate superheating of the boiler whereby the bypass line bypasses the high-pressure steam turbine;

a high-pressure bypass station arranged in the bypass line whereby when the power station is in the starting up phase and the boiler is operating in a minimum load, the steam produced bypasses the high-pressure turbine in the bypass line via the high-pressure bypass station and is supplied to an intermediate superheating with the boiler;

a supporting line connected from the feed-water container to the intermediate superheating; and an electrical load connected to the generator during a starting-up phase of the steam power station for increasing a steam mass flow in the high-pressure steam turbine before synchronization of the generator to an electrical power supply network.

4. The steam power station as claimed in claim 3, wherein the electrical load is arranged in a feed-water container of the steam power station.

5. The steam power station as claimed in claim 3, wherein the electrical load is an electrical resistor.

* * * * *